United States Patent [19]

Simon et al.

[11] 4,041,877

[45] Aug. 16, 1977

[54] LATERAL GUIDANCE DEVICE FOR WHEEL SETS OF RAIL VEHICLES

[75] Inventors: Michael Simon, Munich-Obermenzing; Norbert Degen, Munich, both of Germany

[73] Assignee: Maschinenfabrik Augsburg-Nurnberg Aktiengesellschaft, Germany

[21] Appl. No.: 558,539

[22] Filed: Mar. 17, 1975

[30] Foreign Application Priority Data

Mar. 16, 1974 Germany ..... 2412823

[51] Int. Cl.[2] ..... B61F 5/44; B61F 5/50; B61F 9/00; B61F 19/00

[52] U.S. Cl. ..... 104/242; 104/1A; 105/77; 105/157 R

[58] Field of Search ..... 104/148 LM, 148 MS, 104/1 A, 1 R, 242; 105/1 R, 77, 78, 215 R, 157 R

[56] References Cited

U.S. PATENT DOCUMENTS

| | | | |
|---|---|---|---|
| 867,147 | 9/1907 | Ochoa | 105/77 |
| 2,864,318 | 12/1958 | Toulmin, Jr. | 104/1 A X |
| 3,233,559 | 2/1966 | Smith et al. | 104/1 A X |
| 3,941,062 | 3/1976 | Machefert-Tassin | 105/77 |

FOREIGN PATENT DOCUMENTS

| | | | |
|---|---|---|---|
| 2,104,280 | 3/1972 | France | 104/148 MS |

*Primary Examiner*—L. J. Paperner
*Assistant Examiner*—Howard Beltran
*Attorney, Agent, or Firm*—Craig & Antonelli

[57] ABSTRACT

Lateral magnetic guidance apparatus for laterally guiding a wheel set of a rail vehicle with respect to a support rail. The apparatus includes electromagnets carried with the wheel sets and positioned and controlled so as to effect return of the wheel set to a central position along the rail whenever the wheel set deviates from the central position. At least one electromagnet is provided which has a multi-piece pole shoe with a plurality of pole faces disposed longitudinally spaced from one another along the support rail.

7 Claims, 3 Drawing Figures

LATERAL GUIDANCE DEVICE FOR WHEEL SETS OF RAIL VEHICLES

BACKGROUND AND SUMMARY OF THE INVENTION

This invention relates to lateral guidance devices for wheel sets of rail vehicles, by producing, by magnets attached to the wheel set, a magnetic field, whereby, due to the force interaction between the magnetic poles, on the one hand, and one or several rails, on the other hand, the lateral guidance of the wheel set is accomplished without contact. This invention is more specifically directed to an improvement in the lateral guidance devices disclosed in commonly assigned copending U.S. Pat. application Ser. No. 457,215, filed Apr.1, 1974, the subject matter of which is hereby incorporated herein by reference thereto to the extent necessary for a complete understanding of the present invention.

Such devices have the purpose to dampen the low frequency transverse vibrations occurring at high speed of the rail vehicle; the higher the driving speed of such a vehicle, the higher also the frequency of the driving impacts from the rail to the chassis, which have to be designed in a way to dampen those "high frequency" impacts. At high speeds in addition to the driving impacts there occur slow transverse vibrations which can be caused by the lateral running of the rims. These transverse vibrations are in the frequency of 6 Hz and these transverse vibrations are dampened by devices of the aforementioned kind.

It has been determined that devices of the aforementioned kind are only efficient up to a certain driving speed, and then constantly lose their effect.

It is an objective of the invention to provide a device of the aforementioned kind in a way that will be efficient even at high driving speeds. This objective is attained by the fact that the pole faces of the magnets are extending along the rail according to the present invention; here the length of the pole face depends on the intended maximum speed. It has been determined that at high driving speeds the field lines between the magnet and the rail come to a stop, so consequently the dampening effect also comes to a stop. Elongated pole faces even at speeds of over 400 km/h still create a magnetic field in relation to the rail being sufficient for dampening purposes.

Furthermore, it has been determined that the operation of the aforementioned device is braking the vehicle stronger with increasing speed. This breaking effect has been accepted so far, and one has expected from it an improvement of the dampening characteristics. However such an improvement in the dampening characteristics is not possible since the braking power is in a vertical (perpendicular) relation (position) to the transverse vibrations to be dampened. It is therefore a further objective of a further embodiment and feature of the invention to decrease the braking losses of a device of this kind.

This further objective is attained according to the present invention by providing controlling apparatus in the magnetic poles which creates magnetic field running proportionally to the driving speed of the rail vehicle. Hereby the magnetic field stays on the rail, so to speak, respectively hurries slightly ahead or behind, whereby the braking effect caused by the inhomogeneities in the rail are not present anymore. Since those skilled in the art can construct such controlling apparatus, given the state of the art and the present disclosure, details thereof are not included herein in order not to obscure the present invention.

A further embodiment of the invention provides that electrical generators are connected with (appointed to) each of the wheel sets for controlling the magnets. In this further embodiment, with increasing driving speed also the capacity and the frequency of the magnetic field increase, thus leaving out any central control. Moreover the magnet arrangement according to preferred embodiments of the invention represents a piece of the construction belonging to the single rail vehicle, this piece coming into operation by itself dependent on the speed and being free of interference and supervision.

These and further objects, features and advantages of the present invention will become more apparent from the following description when taken in connection with the accompanying drawings which show, for purposes of illustration only, several embodiments in accordance with the present invention.

DETAILED DESCRIPTION OF THE DRAWINGS

Figure 1:
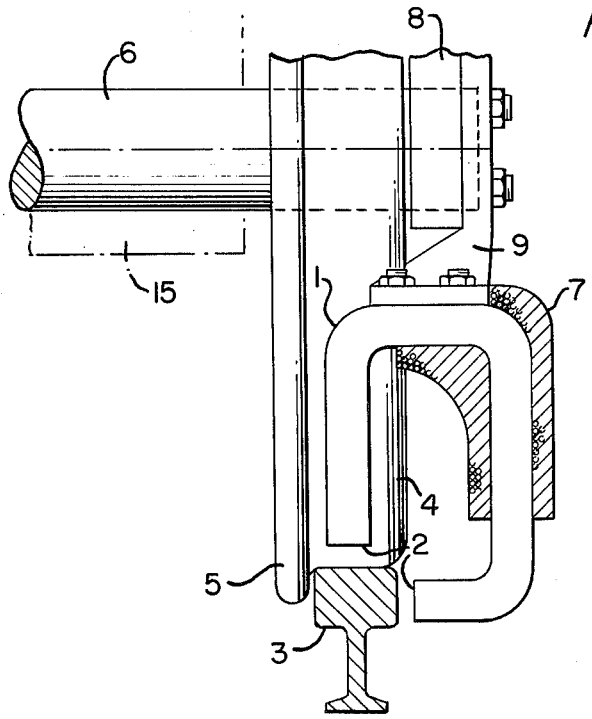
FIG. 1 is a schematic sectional view taken at right angles to a vehicle travel direction of a first preferred embodiment of the present invention.
Figure 2:
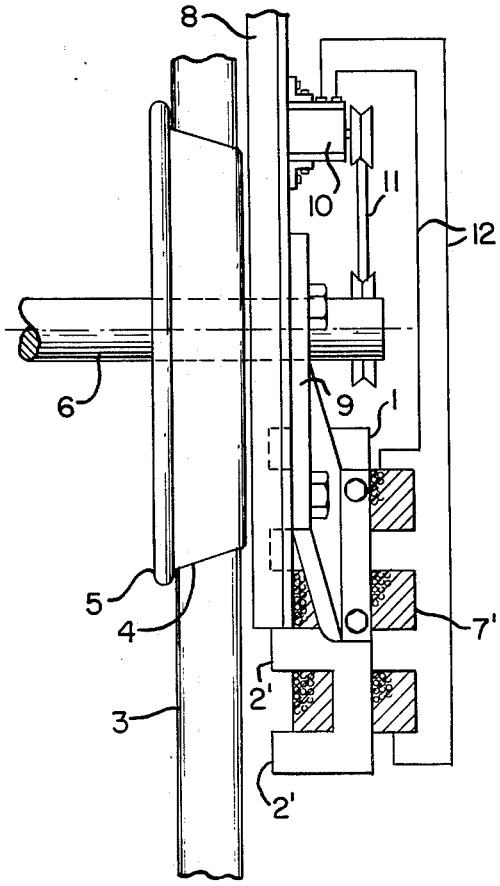
FIG. 2 is a schematic top view of a further preferred embodiment of the present invention.

In each of the embodiments of FIGS. 1 and 2, the lateral guide magnets are disposed with their pole faces 2, 2' such as to apply lateral guiding forces upon lateral deviation of the wheel set carrying the magnets with respect to rail 3. The above-mentioned copending application describes and depicts the wheel set connection with the magnets. It will be understood that the magnets are carried by the wheel sets such that lateral deviations of the wheel sets with respect to the rail 3 will necessarily result in a corresponding lateral deviation of the magnets. Also, lateral magnetic guiding forces are transmitted to the respective wheel sets because the magnets are supported at and movable with the wheel sets. In preferred arrangements the magnets are pivotally mounted with respect to the wheel sets to accommodate movement into and out of in-use positions, especially if such movement is desirable for avoiding rail switches and the like. In other preferred arrangements such movement is unnecessary and the magnets are mounted accordingly. FIGS. 1 and 2 only schematically depict guidance apparatus for one side of a single rail, it being understood that further apparatus at the same or another rail will be provided so as to effect guidance of the wheel set and train vehicle (see said copending application).

Figure 3:
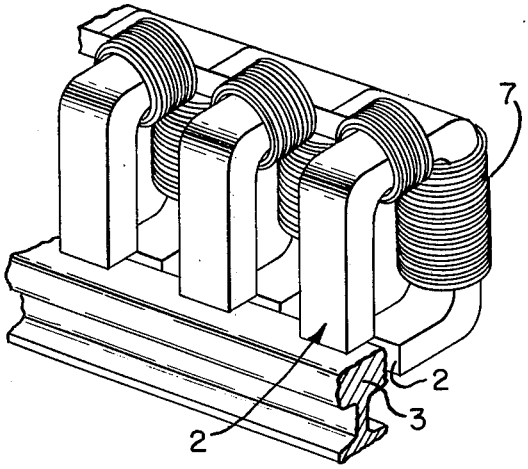
FIG. 3 is a perspective view of the magnet arrangement of FIG. 1.

In the embodiment of FIG. 1, the electromagnet has a magnetic coil 7 and an elongated pole shoe 1, forming in effect two multi-piece pole shoes; the pole faces 2 of which are extending perpendicularly to the surface plane. The multi-piece pole shoes have a plurality of pole faces 2 extending along the rail 3 as more clearly shown in FIG. 3. In a manner similar to that described in the co-pending application, the electromagnet is joined with the wheel set by any suitable connection member such as a bracket member 9 connected by bolts or the like to a frame 8 which fits on the wheel axle 6 of the wheel 4 having a rim 5 of the rail vehicle 15.

In the embodiment of FIG. 2, the magnetic coil 7' is connected with a multi-piece pole shoe 1; the pole faces 2' of which create a magnetic field with respect to the rail 3. The plurality of pole faces 2' in the longitudinal direction provides advantageous dampening even at high speeds.

In a preferred embodiment of the FIG. 2 arrangement, each magnet includes between 5 and 8 pole faces 2', which pole faces have individual lengths in the range of 50 – 100 mm. The overall length of said magnet is approximately 1 m. With such a magnet, and a spacing of the pole faces 2' from rail 3 a distance in the range of 1 – 10 mm (4 – 5 mm normal spacing, the larger range caused byvarying position of the wheel set with respect to the rail during use), good results are obtained for a vehicle speed of approximately 240 miles/hour.

In preferred embodiments control apparatus is provided for producing a continuous magnetic field passing the magnetic means in a direction opposite to the vehicle direction with the frequency of the magnetic field proportional to the vehicle speed. Particularly preferred embodiments include an electric generator connected to the respective wheel sets, which electric generator generates an alternating current with a frequency which depends on the speed of the rail vehicle, said alternating current supplying the coil 7, 7' of the magnets. As shown for example in FIG. 2, an electric generator 10 is mounted on the frame 9 and is driven in accordance with the speed of the wheel or rail vehicle by a suitable drive arrangement coupled to the wheel axle 6. The generator 10 thus provides an alternating current having a frequency which is proportional to the speed of the vehicle to the coil 7' via electric leads 12.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Lateral guidance apparatus for laterally guiding a wheel set of a rail vehicle as wheel means of the wheel set travel in a longitudinal direction along a support rail; said apparatus comprising:

magnet means, and magnet support means for supporting said magnet means at said wheel set such that force interaction between magnet pole means of said magnet means and guide rail means effects lateral guidance of said wheel set with respect to said support rail, said magnet means and said guide rail means being continuously spaced from one another, wherein pole faces of said magnet means extend longitudinally along the support rail when in operative positions carried by said vehicle, and wherein said magnet means includes at least one electromagnet having a multi-piece pole shoe with a plurality of pole faces disposed longitudinally spaced from one another along the support rail.

2. Apparatus according to claim 1, wherein said plurality of pole faces is greater than two.

3. Apparatus according to claim 2, wherein a control means produces a continuous magnetic field passing the magnetic means in a direction opposite to the vehicle direction, the frequency of said continuous magnetic field being proportional to the speed ofthe vehicle.

4. Apparatus according to claim 3, wherein an electric generator is connected to the wheel set, said generator generating an alternating current with a frequency which depends on the speed of the rail vehicle and thus producing the continuous magnetic field in the magnetic means.

5. Apparatus according to claim 3, wherein the capacity of said magnetic field is proportional to the speed of the vehicle.

6. Apparatus according to claim 1, wherein said electromagnet having two multi-piece pole shoes, the pole faces of which are perpendicular to each other.

7. Apparatus according to claim 1, wherein said multi-piece pole shoe is provided with at least three serially arranged individual pole faces.

* * * * *